US007522737B2

(12) United States Patent
Solderits

(10) Patent No.: US 7,522,737 B2
(45) Date of Patent: Apr. 21, 2009

(54) MICROPHONES WITH EQUAL SENSITIVITY

(75) Inventor: Thomas Solderits, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 925 days.

(21) Appl. No.: 10/675,808

(22) Filed: Sep. 30, 2003

(65) Prior Publication Data

US 2004/0120531 A1 Jun. 24, 2004

(30) Foreign Application Priority Data

Oct. 1, 2002 (AT) ..... A 1486/2002

(51) Int. Cl.
*H04R 3/00* (2006.01)

(52) U.S. Cl. ..... 381/111; 381/113

(58) Field of Classification Search ..... 381/111, 381/122, 58, 113, 92, 369, 313, 174, 355; 29/896.2, 807.01, 407.05, 426.1, 426.4
See application file for complete search history.

(56) References Cited

U.S. PATENT DOCUMENTS

| | | | | |
|---|---|---|---|---|
| 5,161,203 | A | 11/1992 | Buckley | |
| 5,378,385 | A * | 1/1995 | Thomas et al. | 252/68 |
| 6,151,399 | A * | 11/2000 | Killion et al. | 381/313 |
| 6,915,555 | B2 * | 7/2005 | Ajiki | 29/594 |

FOREIGN PATENT DOCUMENTS

| | | |
|---|---|---|
| EP | 0 441 549 | 8/1991 |
| EP | 1 057 638 | 12/2000 |
| WO | WO 01/78446 | 10/2001 |

* cited by examiner

*Primary Examiner*—Xu Mei
*Assistant Examiner*—Lun-See Lao

(57) ABSTRACT

A microphone and a method for producing a microphone with a sensitivity stipulated within narrow limits. The microphone each has a microphone capsule and an amplifier. A network of passive components, preferably resistors, is allocated to the amplifier. The sensitivity of the microphone is measured and the passive components are then disconnected to change the amplification of amplifier in the desired manner.

6 Claims, 3 Drawing Sheets

MICROPHONES WITH EQUAL SENSITIVITY

BACKGROUND OF THE INVENTION

1. Field of the Invention

The present invention relates to a method for the production of microphones with equal sensitivity, in which each microphone has a microphone capsule and an amplifier. The invention further relates to the microphone itself.

2. Description of the Related Art

Microphones exist in the prior art consisting of a microphone capsule and a microphone amplifier connected, if possible, directly to it, hereafter generally called "amplifier". The microphone capsule serves to convert soundwaves into electrical voltage. The microphone amplifier serves to amplify the voltage coming from the microphone capsule. The electrical and structural connection of the microphone capsule and microphone amplifier is generally called a microphone for short.

The two large variables for the sensitivity of a microphone lie in the microphone capsules and the microphone amplifier. The sensitivity tolerance of the microphone capsule and the amplification tolerance of the amplifier are decisive for the fluctuations of sensitivity from microphone to microphone. Ordinarily, tolerances of about +/−4 dB from the stipulated sensitivity value are assumed, and also are accepted as the standard tolerance of microphone sensitivity, for example, in the automotive industry for hands-free microphones. If a smaller deviation is required in series production, this directly leads to a very high expense, which again leads to a significant increase in manufacturing costs. The achievement of narrower tolerances of microphone sensitivity can be accomplished, for example, with time- and resource-intensive selection of the finished microphones. The sensitivity of each microphone is then measured and classified, according to the result, into stipulated sensitivity classes. This leads to significant organizational and metrological expense and thus makes production more expensive, not to mention the fact that microphones that lie outside of the stipulated sensitivity range must be scrapped, since a correction is not possible or is not possible at an acceptable cost.

The enormously expanding use of microphones in vehicles and the increasing requirements on the quality of microphones have posed difficult tasks to microphone manufacturers. In recent years, so-called array microphones have been developed. Such microphones have a much better directional effect than the thus far known individual microphones. They consist of several individual microphones, which are electronically controlled, in order to achieve a better directional effect. To configure such complicated electronic systems error-free, it is necessary to use individual microphones with the most uniform possible sensitivity. Today, the individual microphones employed are preselected at very high expense to achieve these narrow tolerances, then combined with the same amplifiers, which can be produced without problems with narrow tolerances, since the tolerance ranges of the individual microphones to be used jointly for the aforementioned reasons are much narrower than they otherwise ordinarily must be, namely, in the range of +/−1.5 dB. With a further reduction in the deviation of individual microphones from each other, the logistic expense increases exponentially, which leads to a prohibitive cost explosion and has thus far prevented any industrial implementation of the production of microphones with identical sensitivity.

SUMMARY OF THE INVENTION

Accordingly, it is an object of the present invention to construct such microphones in a simple and cost-effective manner, in order to achieve economically acceptable results even with very narrow stipulated tolerances in the sensitivities of the microphones.

In order to be able to maintain such strict limits simply and cheaply, the invention proposes that the microphone amplifiers are designed to be adjustable and, during the production of the microphone, the amplifier is adjusted to a value through which the stipulated sensitivity of the microphone is obtained in combination with the capsule sensitivity.

Modern microphone amplifiers are offered as integrated circuits by several manufacturers as standardized electronic components. Some of these amplifiers are designed so that their amplification can be adjusted with an externally applied DC voltage applied in a stipulated range. This adjustment can be conducted either with a resistance network or with a potentiometer. Such amplifiers are used wherever a precisely adjustable and/or easily changeable amplification is desired. These are mostly electronic devices with a large electronic integration factor, such as televisions and hi-fi equipment.

It is possible without great expense to accommodate such an amplifier in the housing of a microphone, since its weight and dimensions are much smaller than the usual discretely constructed amplifiers. In principle, the microphone capsule is then soldered to a printed circuit that also has, in addition to electronic components that are necessary for amplifier function, an electronic network of passive components, for example, a resistance network. The resistance network is connected to the electrical control circuit of the amplifier and any change in resistance value influences amplification of the amplifier and therefore the sensitivity of the microphone. The microphone is assembled so that influencing of the resistance network is possible by means of a laser through the openings in the microphone housing.

The passive components can also be capacitive or inductive elements, capacitors or coils, but ohmic resistance devices are preferred for cost reasons, and for better understanding only such resistance devices will subsequently be discussed.

Tuning of the microphone is conducted at the measurement location in a controlled measurement loop. The sensitivity of the microphone is measured, then the superfluous passive components, mostly resistors, or the electrical conductors to the corresponding passive components, are burned away by laser from the outside. The amplification of the amplifier and therefore the sensitivity of the microphone are brought to the desired value in this way.

It is possible to cost-effectively and with the simplest logistics, even in large series, achieve a sensitivity that is the same in all microphones even within the narrowest limits, without the usual broad tolerances. Only minimal fluctuations remain, which are due to the accuracy of the regulated control voltage of the integrated amplifier, primarily from the number of resistors available for regulation.

The various features of novelty, which characterize the invention, are pointed out with particularity in the claims annexed to and forming part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
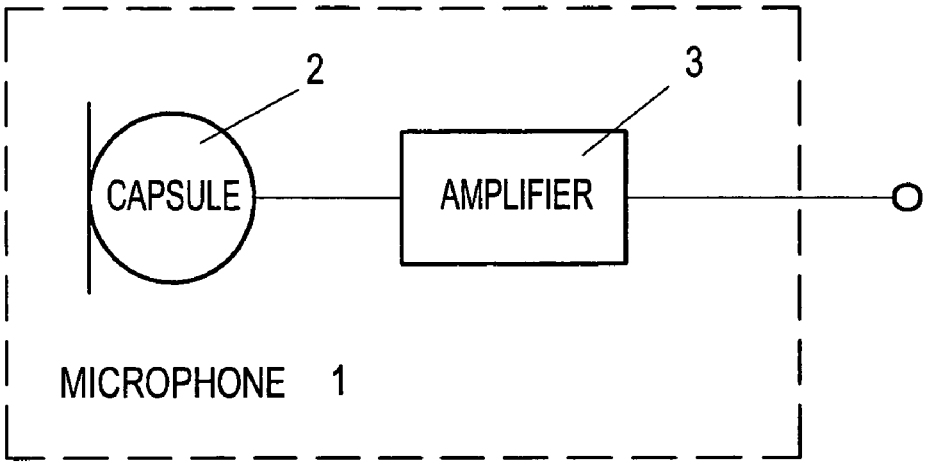
Fig. 1 Prior Art
FIG. 1 shows the design of a microphone according to the prior art.
Figure 2:
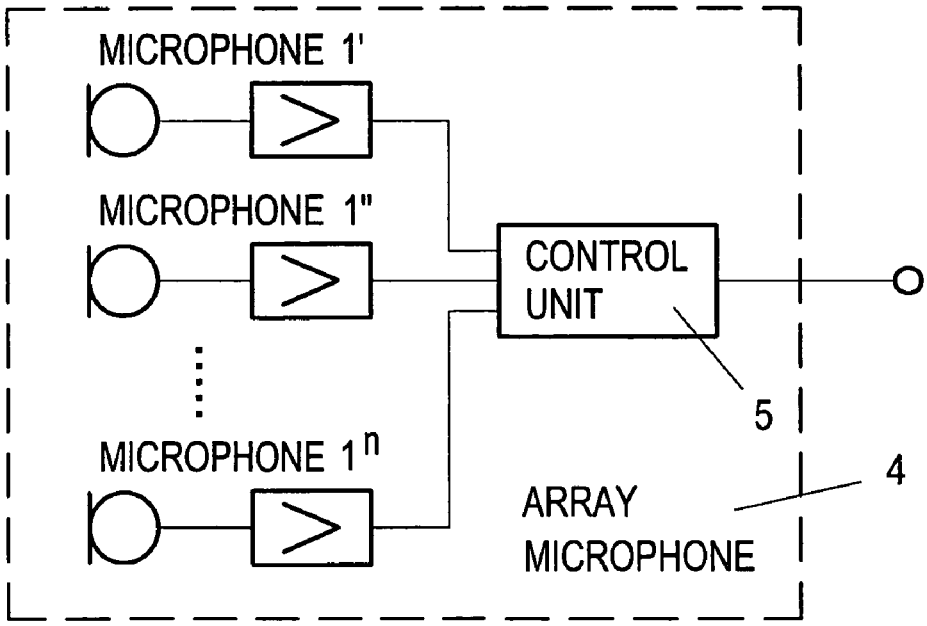
Fig. 2 Prior Art
FIG. 2 shows the design of an array microphone according to the prior art.

The pure principle structure of a microphone 1, consisting of a microphone capsule 2 and an amplifier 3, is shown FIG. 1. FIG. 2 shows the arrangement of several such microphones 1', 1", . . . , 1″, etc. in an array microphone 4 with a common electronic control unit 5.

Figure 3:
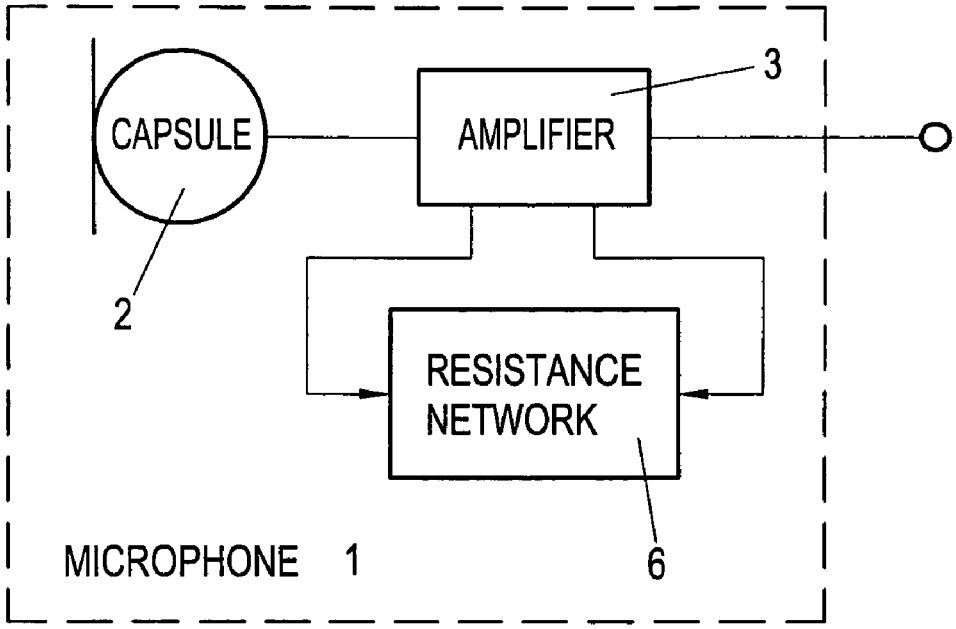
FIG. 3 shows the design of a microphone according to the invention.

FIG. 3 purely schematically shows an individual microphone 1 designed according to the invention. The microphone has, as is customary, a microphone capsule 2 and an amplifier 3. A resistance network 6 is allocated to the amplifier 3, whose total resistance is variable. By changing this total resistance, it is possible to influence the amplification of the amplifier 3 and therefore the sensitivity of the individual microphone 1 in the desired manner.

Figure 4:
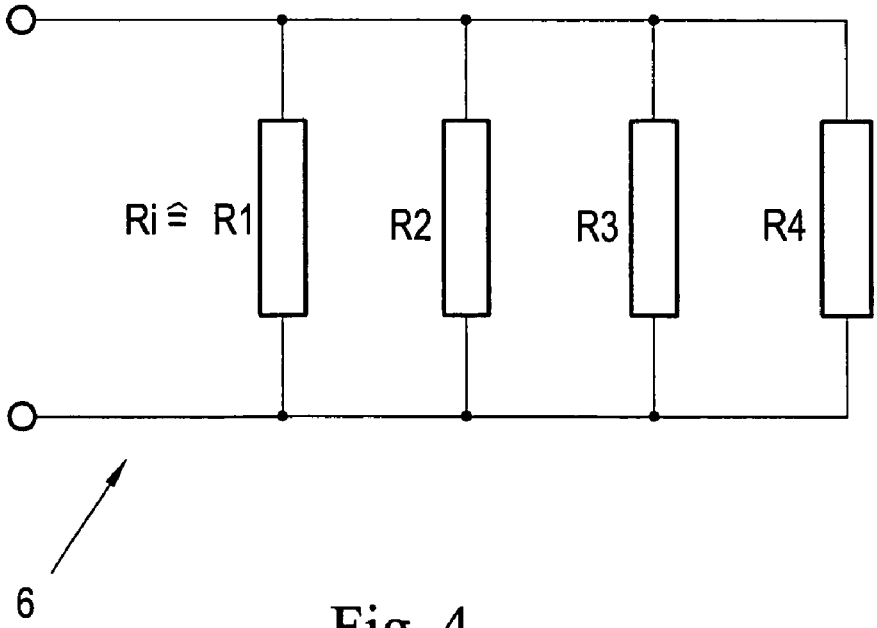
FIG. 4 shows an example of a passive network according to the invention.
Figure 5:
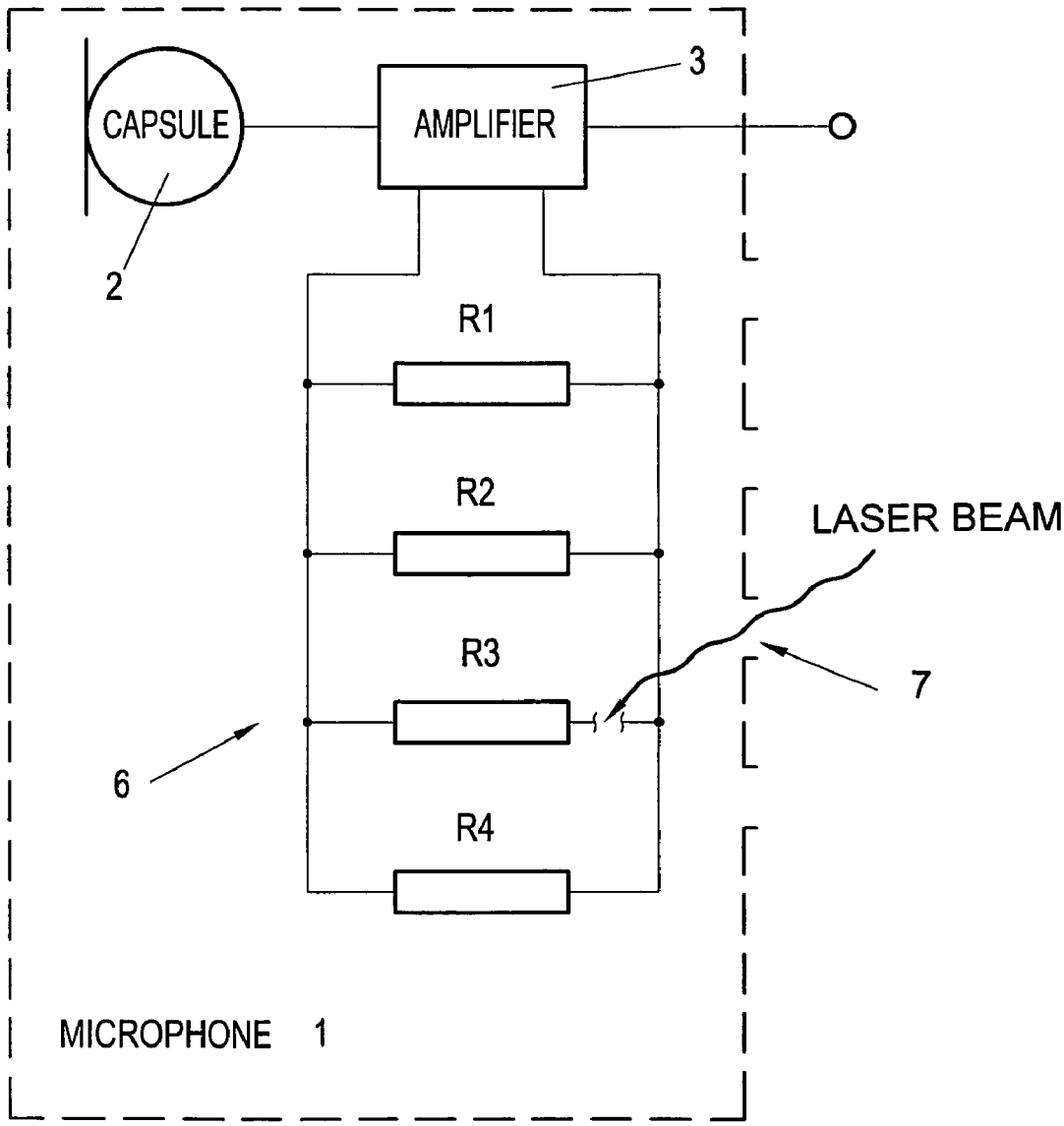
FIG. 5 shows the microphone of FIG. 3, with a schmematically illustrated laser beam destroying a connection to one of the resistors.

An example of the possible design of a resistance network 6 according to the invention is shown in FIG. 4. In this embodiment, as shown in FIG. 5, several resistors Ri are connected parallel to each other and, depending on the measurement result, resistors (or the lines to the resistors) are destroyed by exposure to a laser beam, so that the total resistance of the network changes to the value through which the individual microphone comes into the desired sensitivity range. In order to proceed with the smallest number of resistors Ri with the best possible adjustment of total resistance, there are different strategies that depend on the scatter of the capsule sensitivities to be expected. Thus, it is possible to choose the resistors according to a geometric series:

R1:R2:R3:R4=1:2:3:4.

It is also possible to choose the resistors that are as equally large with respect to each other as possible:

R1=R2=R3=R4.

Naturally, it is not necessary to maintain these strategies or to arrange the resistors exclusively parallel to each other. They can also form a regular network that a person skilled in the art can easily lay out based upon the teachings in the present application.

A not unessential detail for practical use concerns the arrangement of the resistance network and the design of the housing of the individual microphone. In order to facilitate handling and to do so cost-effectively, an opening 7 is provided in the housing through which the laser beam can be targeted on the resistance network. Whether this opening is then closed or remains open depends on the corresponding incorporation situation. It is easy for one skilled in the art with knowledge of the invention to devise a reliable but cost-effective closure, if necessary.

In another embodiment, the resistance network 6 is arranged directly on the circuit board of the amplifier 3, in order to save contacts and lines. FIG. 3, which shows the resistance network, is also a purely schematic depiction in this respect.

The relation between deactivated resistors and the change in sensitivity of the microphone is known to one skilled in the art in the field of electroacoustics, and can be easily determined by such a person with knowledge of the invention with reference to the microphone capsules and amplifiers available. With knowledge of this relation, the resistances which must be disconnected are determined on a case by case basis, in order to impart the desired sensitivity to the microphone.

The invention is not limited by the embodiments described above which are presented as examples only but can be modified in various ways within the scope of the protection defined by the appended patent claims.

I claim:

1. A Method for producing a microphone with a stipulated sensitivity within narrow limits, the microphone having a microcapsule and an amplifier mounted in a housing, the method comprising the steps of:

providing the amplifier with a network of passive components;

measuring the sensitivity of the microphone; and disconnecting the passive components to alter amplification of the amplifier so that the sensitivity of the microphone lies within a the desired range, wherein the disconnecting step includes destroying the passive components with a laser beam directed through openings in the housing.

2. The method according to claim 1, wherein the passive components are resistors.

3. The method according to claim 1, wherein the disconnecting step includes destroying electrical feed lines to the passive components to be disconnected.

4. A microphone having a sensitivity stipulated within narrow limits, comprising:

a housing;

a microphone capsule;

an amplifier; and a network of passive components allocated to the amplifier, at least one of the passive components being disconnected, wherein disconnection of the disconnected component occurs by destruction of an electrical feed line of the component by a laser beam directed through openings in the housing.

5. The microphone according to claim 4, wherein the passive components are resistors.

6. The microphone according to claim 4, wherein the passive component is at least one of a capacitive component and an inductive component.

* * * * *